United States Patent [19]

Halilovic et al.

[11] 4,351,308

[45] Sep. 28, 1982

[54] PHOTOACTIVE IONIZATION HIGH-TENSION PULSATOR OF CARBURETOR MOTOR IGNITION SYSTEM

[76] Inventors: Ešref Halilovic, D. Tucovića 141; Branko Radišić, Lole Ribara 2, both of 11000 Belgrade, Yugoslavia

[21] Appl. No.: 100,552

[22] Filed: Dec. 5, 1979

[30] Foreign Application Priority Data

Dec. 7, 1978 [YU] Yugoslavia ..... 2862/78

[51] Int. Cl.[3] ..... F02P 15/00

[52] U.S. Cl. ..... 123/627; 123/620; 313/124

[58] Field of Search ..... 123/620, 627, 653, 654, 123/169 MG; 313/94, 95, 99, 100, 102, 124, 214; 315/209 M

[56] References Cited

U.S. PATENT DOCUMENTS

| | | | |
|---|---|---|---|
| 1,955,335 | 4/1934 | Knowles | 313/100 |
| 2,765,417 | 10/1956 | Foulke | 313/95 |
| 2,841,629 | 7/1958 | Autrey | 123/620 |
| 3,422,307 | 1/1969 | Langer | 313/100 |

FOREIGN PATENT DOCUMENTS

| | | | |
|---|---|---|---|
| 2056235 | 5/1972 | Fed. Rep. of Germany MG | 123/169 |
| 1136437 | 5/1957 | France | 123/627 |

*Primary Examiner*—Charles J. Myhre
*Assistant Examiner*—Andrew M. Dolinar
*Attorney, Agent, or Firm*—Fleit & Jacobson

[57] ABSTRACT

A photoactive ionization high-tension pulsator is provided between the distributor and the spark plug of a carburetor motor ignition system. The pulsator comprises tubular housing, electrodes disposed therein in spaced apart relationship, and a ring positioned on the inside wall of the tubular housing and being separated from the electrodes. The ring comprises a photoactive material responsive to break down between the electrodes for causing ionization of the gas, whereby to provide high-frequency current in the motor ignition system.

1 Claim, 1 Drawing Figure

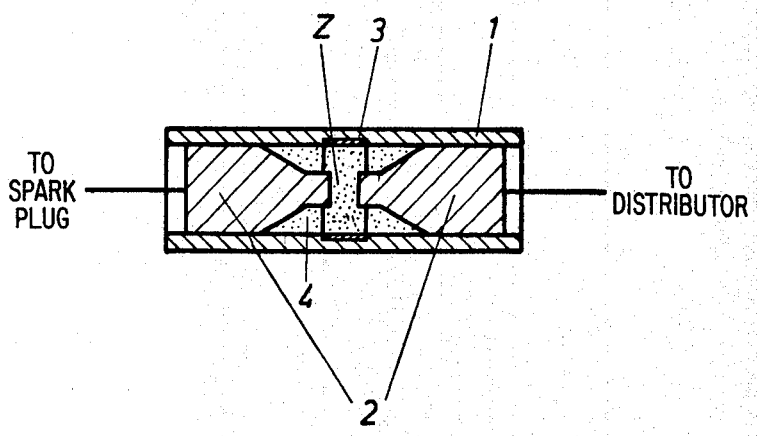
Z
3
1
TO
SPARK
PLUG
TO
DISTRIBUTOR
4
2

PHOTOACTIVE IONIZATION HIGH-TENSION PULSATOR OF CARBURETOR MOTOR IGNITION SYSTEM

The photoactive ionisation high-tension pulsator represents a novel additional component in the high-tension part of the carburetor motor ignition system. In the connection diagram it is inserted between the distributor cap and the motor spark plug. The aim thereof is an improvement of the battery ignition function.

The known carburetor motor ignition systems contain many imperfections. One part of these inperfections relates to the primary low-tension circuit and the other to the high-tension circuit and the other of the high-tension circuit.

Nowadays the improvements of the ignition system function are based on a wide application of semiconductor components and such improved systems are usually called electronic ignition systems. All of them—the so-called contact or contactless electronic systems—are designed on the basis of exploitation of semiconductor components (transistors, thyristors, stabistors) and they solve many important problems in the primary low-tension part of the circuit. They improve the inductive-capacitive characteristics of the whole system as well as the reliability and the endurance of the components thereof.

The contact-transistor and the contact-thyristor systems can be used as an additional equipment with the existing ignition systems.

Contactless semiconductor systems connot be used without a complete change of the whole ignition system.

The imperfection of existing (contact and contactless) semiconductor systems lies in the following:

Contactless systems require a complete changing of the whole ignition system, the contact and contactless systems can withstand a relative low temperature only (germanium semiconductors appr. 350 K, silicon semiconductors appr. 400 K) and do not eliminate the substantial imperfections of the high-tension sectors between the ignition distributor and the spark plugs.

In addition to other improvements, these imperfections are removed by the photoactive ionisation high-tension pulsator according to the invention.

The invention will now be described in detail, with reference to FIG. 1, which is diagrammatic representation of the photoactive ionisation high-tension pulsator of the present invention.

The photoactive ionisation high-tension pulsator schematically shown in FIG. 1 comprises a tubular housing 1, made of an electroinsulating material, electrodes 2, made of a electroconductive material, and a ring 3, made of an photoactive material. The ring 3 is positioned approximately in the middle of the tubular housing 1. The electrodes 2 are firmly fixed in the tubular housing 1 at a mutual distance z. Between the electrodes 2 and the tubular housing 1, an inside space 4 is formed, which is filled with a gas.

The photoactive ionisation high-tension pulsator operates in the following manner:

One electrode 2 of the pulsator is connected to the spark plug cable from the distributor and the second electrode 2 to the spark plug. In such a manner the pulsator is inserted into the high-tension conductor between the distributor and the spark plug. In the period of the arising of the high tension, the pulsator retains the rising of this tension to some defined limit and then a flashover through the gap z takes place. The resistance of the pulsator quickly diminishes and the fully attained high tension is transferred to the spark plug. The electric flashover emits waves of a broad spectrum (among others also UV rays). These waves excite the atoms of the photoactive material of the ring 3, which ionizes the gas in the inside space 4 for a long period after the flashover in the gap z. The ionized gas in the inside space 4 acts in a manner similar a p-n junction in a semiconductor component—it makes possible the flow of a very high current in on direction and of a negligibly low current in the other direction. In such a manner the pulsator possesses the character of an electric valve.

The unidirectional passing of the current through the pulsator as well as the retention of the flashover in the gap of the spark plug until the secondary (high) tension reaches its defined value is of substantial importance for the ignition systems of carburetor motors.

Without the pulsator e.g. the residues of the combustion on the spark plug insulator would, because of their relatively good electric conductivity, make possible a surface leakage current and the secondary tension could not reach its full value because of this conductivity, the spark on the plug would become weaker and would fall out from time to time, which could lead to a total failure of the spark plug function. A weak spark and intermittent falling out of the spark cause an increasingly difficult operation of the motor, make the operation thereof less economical and contribute to environment polution.

Similar difficulties on the secondary side can be caused by moisture and dirt on the cables and on the outer part of the spark plug insulator.

The rise of the secondary tension up to a defined value as ensured by the pulsator according to the invention, is evidently of great importance for an effective ignition, combustion and exploitation of the gaseous mixture.

The unidirectional passing of the current as ensured by the pulsator according to the invention is of great importance too. Without this pulsator the consequence of the sparking of the spark plug is the appearance of high-frequency alternating currents, which extends over the whole high-tension circuit. These high-frequency currents cause radio-interferences as well as the inducing of an elevated tension into the primary circuit in the period of the opening of the interrupter contact. The sparking on the interrupter contact is stronger and longer. This causes a progressive "burning" of the contacts which lose their nominal gap and spoil the function of the whole ignition system until a complete failure thereof.

The pulsator according to the invention prevents the appearance of high-frequency currents in the secondary circuit and said negative consequences thereof, thereyb also improving the primary circuit function, which is also achieved by the semiconductor components used.

Owing to its simple construction and the possbility of its simple inclusion into existing systems of battery ignition as well as owing to low production costs and positive effect in the motor operation, the photoactive ionisation high-tension pulsator can find a wide application in the ignition systems for carburetor motors.

What is claimed is:

1. Photoactive ionisation high-tension pulsator of a carburetor motor ignition system having a distributor and a spark plug providing a high voltage, comprising:

a tubular housing having an inner wall, electrodes disposed in said tubular housing and spaced apart by a gap, there being an inside space between the electrodes and the tubular housing, said inside space being filled with an ionisable gas, and a ring positioned on the inside wall of the tubular housing, said ring being positioned within the inside space filled with the ionisable gas and being separated from the electrodes;

wherein said pulsator is connected to and between said distributor and said spark plug, said high voltage resulting in breakdown across said electrodes, and said ring comprising a photoactive material in surrounding relationship to the gap and responsive to said breakdown for causing ionisation of said gas, whereby to provide high-frequency current in said motor ignition system.

* * * * *